US010591233B2

(12) United States Patent
Colomine et al.

(10) Patent No.: US 10,591,233 B2
(45) Date of Patent: Mar. 17, 2020

(54) MEDIUM-CALIBER AMMUNITION SUPPLY DEVICE WITH TURNTABLE

(71) Applicant: CMI Defence S.A., Loncin (BE)

(72) Inventors: Anthony Colomine, Ixelles (BE); Innokenty Gritskevitch, Liege (BE); Domenico Farinella, Rocourt (BE)

(73) Assignee: CMI DEFENCE S.A., Loncin (BE)

( * ) Notice: Subject to any disclaimer, the term of this patent is extended or adjusted under 35 U.S.C. 154(b) by 0 days.

(21) Appl. No.: 15/774,317

(22) PCT Filed: Oct. 24, 2016

(86) PCT No.: PCT/EP2016/075512

§ 371 (c)(1),
(2) Date: May 8, 2018

(87) PCT Pub. No.: WO2017/080800

PCT Pub. Date: May 18, 2017

(65) Prior Publication Data

US 2019/0339033 A1 Nov. 7, 2019

Related U.S. Application Data

(60) Provisional application No. 62/253,236, filed on Nov. 10, 2015.

(30) Foreign Application Priority Data

Dec. 17, 2015 (BE) ..... 20155827

(51) Int. Cl.
*F41A 9/00* (2006.01)
*F41A 9/30* (2006.01)
(Continued)

(52) U.S. Cl.
CPC ..... *F41A 9/30* (2013.01); *F41A 9/55* (2013.01); *F41A 9/79* (2013.01); *F41A 9/86* (2013.01)

(58) Field of Classification Search
CPC ..... F41A 9/29; F41A 9/30; F41A 9/54–57; F41A 9/79–81; F41A 9/86
See application file for complete search history.

(56) References Cited

U.S. PATENT DOCUMENTS 3,602,088 A 8/1971 Spring
3,687,004 A 8/1972 Faisandier
(Continued)

FOREIGN PATENT DOCUMENTS

CA 3026446 A1 * 12/2017 ..... F41A 9/34
CN 101660886 A 3/2010
(Continued)

*Primary Examiner* — Gabriel J. Klein
(74) *Attorney, Agent, or Firm* — Leydig, Voit & Mayer, Ltd.

(57) ABSTRACT

A medium-caliber ammunition supply device for a turret mounted on an armored vehicle includes: at least one circular turntable, placed at the rear of the turret, for positioning medium-caliber ammunition in a strip or chain, vertically and along a spiral path; and structural elements for guided and pulled conveyance of at least one strip or chain of medium-caliber ammunition. The structural elements include at least a conveyor and a ratchet box. The structural elements successively include a first conveyor, a first ratchet box, a second conveyor, and a second ratchet box. The at least one circular turntable and the structural elements all are covered with a sheet-metal protection on their side faces and/or on an upper part or roof. The sheet metal protection has mobile hatches mounted in a rotating or pivoting manner, allowing partial or complete and ergonomic (re)loading and/or unloading of the at least one circular turntable.

18 Claims, 7 Drawing Sheets

(51) Int. Cl.

| | |
|---|---|
| ***F41A 9/55*** | (2006.01) |
| ***F41A 9/79*** | (2006.01) |
| ***F41A 9/86*** | (2006.01) |

(56) References Cited

U.S. PATENT DOCUMENTS

| | | | |
|---|---|---|---|
| 4,332,097 | A | 6/1982 | Taylor, Jr. |
| 4,601,230 | A | 7/1986 | Leblanc |
| 4,674,392 | A | 6/1987 | Beckmann |
| 4,840,108 | A | 6/1989 | Huerlemann et al. |
| 4,951,547 | A | 8/1990 | Novet et al. |
| 5,107,750 | A | 4/1992 | Buchstaller et al. |
| 5,561,258 | A | 10/1996 | Bentley et al. |
| 5,684,265 | A | 11/1997 | Strasser et al. |
| 5,905,224 | A | 5/1999 | Jordan |
| 8,485,083 | B1 | 7/2013 | Care |
| 2006/0249131 | A1 | 11/2006 | Broersma |
| 2007/0107592 | A1 | 5/2007 | Snow |
| 2008/0083322 | A1 | 4/2008 | Becker |
| 2009/0120271 | A1 | 5/2009 | Diller et al. |
| 2012/0024144 | A1 | 2/2012 | Chiappini et al. |
| 2012/0117840 | A1 | 5/2012 | Chewning et al. |
| 2012/0227300 | A1 | 9/2012 | Seeley et al. |
| 2014/0096671 | A1 | 4/2014 | Jiang |
| 2015/0219414 | A1 | 8/2015 | No |
| 2016/0025441 | A1 * | 1/2016 | Lung ..... F41A 9/79 89/37.07 |

FOREIGN PATENT DOCUMENTS

| | | | | |
|---|---|---|---|---|
| CN | 201837306 | U | 5/2011 | |
| DE | 2448313 | C1 | 10/1985 | |
| DE | 3838758 | A1 | 5/1990 | |
| DE | 4206644 | A1 | 9/1993 | |
| EP | 0210713 | A1 | 2/1987 | |
| EP | 0272399 | A1 | 6/1988 | |
| EP | 0290031 | A1 | 11/1988 | |
| EP | 0361050 | A1 | 4/1990 | |
| EP | 0754926 | A2 | 1/1997 | |
| EP | 1589312 | A1 * | 10/2005 | ..... F41A 9/79 |
| EP | 1589312 | A1 | 10/2005 | |
| EP | 1612502 | A1 | 1/2006 | |
| EP | 1749179 | A1 | 2/2007 | |
| FR | 1581603 | A | 9/1969 | |
| FR | 1581603 | A * | 9/1969 | ..... F41A 9/29 |
| GB | 574994 | A * | 6/1938 | ..... F41A 9/54 |
| GB | 555267 | A * | 8/1943 | ..... F41A 9/30 |
| WO | WO 2005111527 | A1 | 11/2005 | |
| WO | WO 2011155971 | A1 | 12/2011 | |
| WO | WO 2013087053 | A1 | 6/2013 | |
| WO | WO 2014035032 | A1 | 3/2014 | |

* cited by examiner

MEDIUM-CALIBER AMMUNITION SUPPLY DEVICE WITH TURNTABLE

CROSS-REFERENCE TO PRIOR APPLICATIONS

This application is a U.S. National Phase application under 35 U.S.C. § 371 of International Application No. PCT/EP2016/075512, filed on Oct. 24, 2016, and claims benefit to U.S. Provisional Patent Application No. 62/253,236, filed on Nov. 10, 2015, and Belgian Patent Application No. 2015/5827, filed on Dec. 17, 2015. The International Application was published in French on May 18, 2017 as WO 2017/080800 under PCT Article 21(2).

FIELD

The present invention relates to the technical field of pulled and guided medium-caliber ammunition storage and supply devices, in particular found inside a turret mounted on an armored vehicle.

The invention can also potentially apply to large-series bottle production chains with conveyors.

BACKGROUND

Racks, magazines, rails or bays are known for storing medium-caliber ammunition for armored-vehicle turrets in which the storage takes place on a single or dual turntable often located at the rear of the turret while the guiding, pulling and conveyance of the ammunition is achieved between this or these turntable(s) and the barrel generally situated at the front of the turret, passing through various specific guiding, pulling and/or conveying structures such as conveyors and ratchet boxes. The passage of the medium-caliber ammunition between the rack and its conveying structures and the barrel can occur through hoses.

It is, however, desirable to maximize the space inside the turret and improve the overall ergonomics thereof, for example by:

- minimizing the size of the structures for storing the medium-caliber ammunition by placing one or several turntable(s), also called feeder(s), located at the rear of the turret;
- reducing the guiding, pulling and/or conveying forces for the medium-caliber ammunition during the transfer thereof from the feeder(s) to the barrel via a completely mechanical system by providing a set of specific and consecutive structural guiding elements such as a conveyor, a ratchet box, or both;
- facilitating the (re)loading and/or unloading of the medium-caliber ammunition throughout the entire path of the latter when the vehicle is stopped, or possibly in motion.

It may also be desirable to increase the safety of the occupants of the turret. Thus, high-density polyethylene (HDPE) strips, as used in most bottle or can conveying systems, can be placed along the entire conveyor in order to reduce friction between the structure and the medium-caliber ammunition during the motion of the latter, in other words to decrease the risks of detachment of the strips or chains of medium-caliber ammunition. Furthermore, it is possible to provide a groove in the middle of the conveying path to prevent the deposition of dirt therein, such as crushed stone, dust, etc. liable to ignite the ammunition. Lastly, using a ratchet box, which designates a device containing a ratchet wheel, the curved teeth of which allow to better match the shape of the medium-caliber ammunition and of their link, facilitates the handling of the medium-caliber ammunition up to the barrel, in addition to its role dedicated to the pulled and guided conveyance (see above).

Currently, these needs are met through the use of different types of medium-caliber ammunition racks, where the ammunition is stored either vertically or horizontally. These operate with or without any electricity supply, given that the feeder(s), whether stationary or rotating, is (are) located either directly next to the barrel, or at the rear of the turret.

More specifically, three types of solutions exist in the state of the art:

- ammunition racks with two feeders have catching and winding specificities providing a spiral path for the ammunition arranged vertically, ideally with no friction between pieces of ammunition, the whole being controlled by a mechanism based on a specific brake. This approach shows a device that is generally located very close to the barrel, that does not have any structural intermediary aside from the aforementioned hoses, and in which the two feeders are located on either side of the barrel;
- ammunition racks presenting pieces of ammunition positioned vertically in a spiral or serpentine path and pulled via a motorized conveyor belt, from the feeder(s) located at the rear of the turret, to the barrel. This conveyance occurs through various structural elements, such as a ratchet box, a conveyor, etc., either on the same side of the barrel, or on either side thereof;
- ammunition racks in which the pieces of ammunition are stored horizontally in the rack itself and arranged along a path with successive turns. Each stage will bring the pieces of ammunition to a different hose, such that the selection will occur at the level of the barrel. In this configuration, the medium-caliber ammunition can also be driven from the magazine to the barrel using a ratchet box.

These different types of ammunition racks are in particular described in the following documents: EP0754926, US2014096671, WO2014035032, CN201837306, WO2011155971, EP1749179, US2012227300, WO2013087053, US2012117840, CN101660886, US2007107592, US2006249131, EP1612502, U.S. Pat. Nos. 5,905,224, 5,561,258, DE3838758, EP0290031, U.S. Pat. No. 4,601,230, EP0210713, U.S. Pat. No. 4,332,097, EP 1589312, EP0272399, US2012/0024144, EP0361050, U.S. Pat. No. 4,674,392, US20090120271, DE4206644, U.S. Pat. No. 8,485,083.

Most of these prior-art solutions require significant pulling forces due to the friction generally present between the structure and the medium-caliber ammunition, often making it necessary to add a motor in order to pull the medium-caliber ammunition toward the barrel, especially when the magazines are away from the barrel and/or produce a significant bulk within the turret, which may reduce the storage capacity of the magazine(s). Lastly, the mechanical complexity of these devices increases the manufacturing time and production cost thereof.

SUMMARY

In an embodiment, the present invention provides a medium-caliber ammunition supply device for a turret mounted on an armored vehicle, comprising: at least one circular turntable, configured to be placed at the rear of the turret, configured to position medium-caliber ammunition in a strip or chain, vertically and along a spiral path; and structural elements for guided and pulled conveyance of the at least one strip or chain of medium-caliber ammunition, which structural elements successively comprise a first conveyor, a first ratchet box, a second conveyor, and a second ratchet box, wherein the at least one circular turntable and the structural elements are covered with a sheet-metal protection on their side faces and/or on an upper part or roof, the sheet metal protection having mobile hatches mounted in a rotating or pivoting manner, allowing partial or complete and ergonomic (re)loading and/or unloading of the at least one circular turntable with medium-caliber ammunition, either when stopped or during movement of the vehicle, from inside and/or outside of the turret and allowing access to the medium caliber ammunition or (re)loading and/or unloading thereof in the conveyors.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
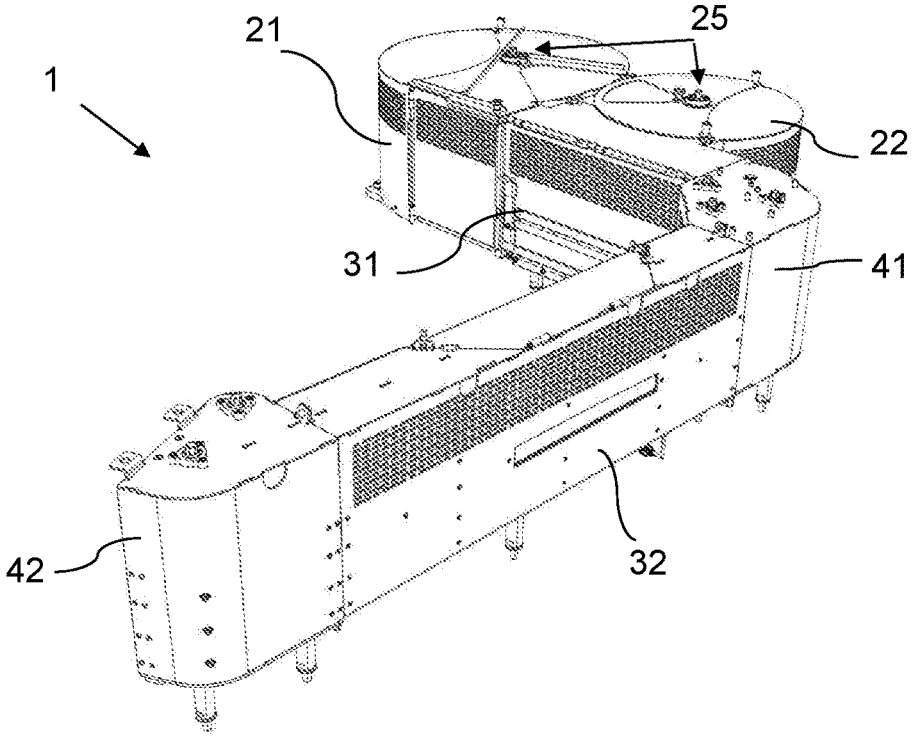
FIG. 1 shows a general perspective view of one embodiment for an ammunition supply device according to the present invention.

In an embodiment, the present invention provides a device that allows to decrease the friction occurring on the path of the medium-caliber ammunition without using a driving force, for example electric, other than that proposed by the motor of the barrel.

In an embodiment, the invention optimizes the space used inside the turret and to facilitate access to the compartments of the device for (re)loading and/or unloading.

In an embodiment, the invention also provides (re)loading and/or unloading means for medium-caliber ammunition at the level of the feeder(s) from the inside and/or outside of the turret.

In an embodiment, the invention allows easy use of the medium-caliber ammunition rack during (re)loading and/or unloading operations.

In an embodiment, the invention simplifies the mechanism in order to avoid as many failure risks as possible and increase reliability.

In an embodiment, the invention provides a device suitable for all types of medium-caliber ammunition (typically from 15 to 50 mm) without modifying its component elements.

A first aspect of the present invention relates to a medium-caliber ammunition supply device intended for a turret mounted on an armored vehicle, comprising at least one circular turntable, intended to be placed at the rear of said turret, for positioning medium-caliber ammunition in a strip or chain, vertically and along a spiral path, followed by the structural elements for guided and pulled conveyance of at least one strip or chain of medium-caliber ammunition, which comprise at least a conveyor and a ratchet box, characterized in that said structural elements for guided and/or pulled conveyance successively comprise a first conveyor, a first ratchet box, a second conveyor and a second ratchet box, said circular turntable and said structural elements for guided and pulled conveyance all being covered with a sheet-metal protection on their side faces and/or on an upper part or roof, said sheet-metal protection having mobile hatches mounted rotating or pivoting, allowing partial or complete and ergonomic (re)loading and/or unloading of the circular turntable with medium-caliber ammunition, either when stopped or during the movement of the vehicle, from the inside and/or outside of the turret and allowing access to the medium-caliber ammunition or (re)loading and/or unloading thereof in the conveyors.

According to preferred embodiments of the invention, the medium-caliber ammunition supply device further comprises at least one of the following features, or any suitable combination thereof:

- the two ratchet boxes each have an axle that can be manually rotated to allow a partial motion of the strip or chain of medium-caliber ammunition toward the barrel from outside the device;
- said axle that can be manually rotated has an outside machining allowing it to be rotated by a standard socket wrench;
- the device comprises at least two circular turntables, if applicable with different sizes, associated with the guided and pulled conveyance of corresponding strips or chains of medium-caliber ammunition;
- the mobile hatches of the sheet-metal protection, mounted rotating, comprise at least two circular sectors that slide relative to one another at the level of the roof of the circular turntable and that can be actuated by means of small handles;
- the mobile hatches of the sheet-metal protection, mounted pivoting, comprise sheet-metal plates mounted on hinges that can be unlocked by opening clips or bolts;
- the protection of the circular turntable comprises at least a mobile sheet-metal hatch mounted rotating and a mobile hatch mounted pivoting;
- the protection of the structural elements for guided and pulled conveyance comprises at least a mobile sheet-metal hatch mounted pivoting;
- the device comprises a mechanical fastening system connecting the last piece of medium-caliber ammunition to the central axle of the turntable, said ammunition being stored in the form of a spiral path at the level of the turntable(s);
- the two conveyors have an open loading window favoring the (re)loading and/or unloading of short strips or chains and the attachment of medium-caliber ammunition when at least one turntable is empty and/or when the second conveyor requires it, respectively;

the device comprises at least one mechanical sensor detecting the end of a strip or chain for each ammunition strip or chain path in order to detect the number of pieces of medium-caliber ammunition remaining in the device;

the structural elements for guided and pulled conveyance are designed for passing from one type of ammunition to another, with no geometric and technical modification or constraint;

each turntable has a retractable central axle that allows stacking on a similar turntable;

the turntable(s) have opening systems allowing simultaneous (re)loading and/or unloading from the inside and the outside of the turret;

a single shared socket wrench is necessary and sufficient to manipulate and convey the medium-caliber ammunition along said entire device.

A second aspect of the present invention relates to an armored-vehicle turret comprising a medium-caliber ammunition supply device as described above, as well as a barrel and hoses allowing to connect said structural elements for guided and pulled conveyance to the barrel at one end of said structural elements located on the same side as the barrel within the turret, for example on the side of the commander of the armored vehicle.

Figure 2:
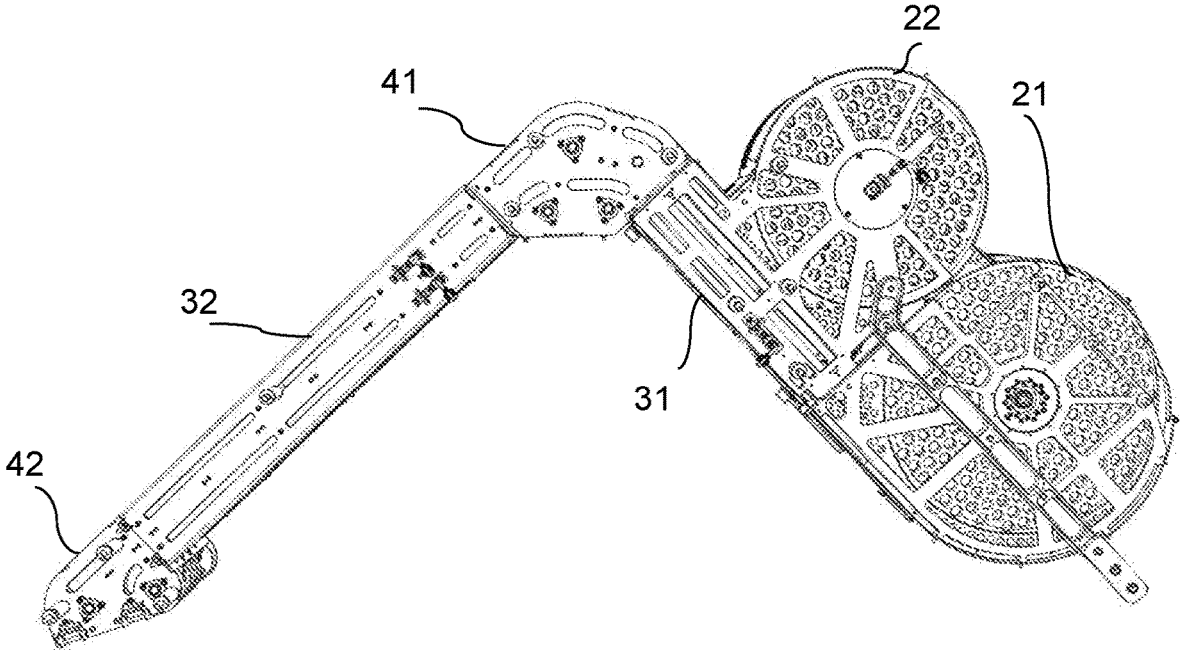
FIG. 2 shows a general bottom view of the device of FIG. 1.
Figure 3:
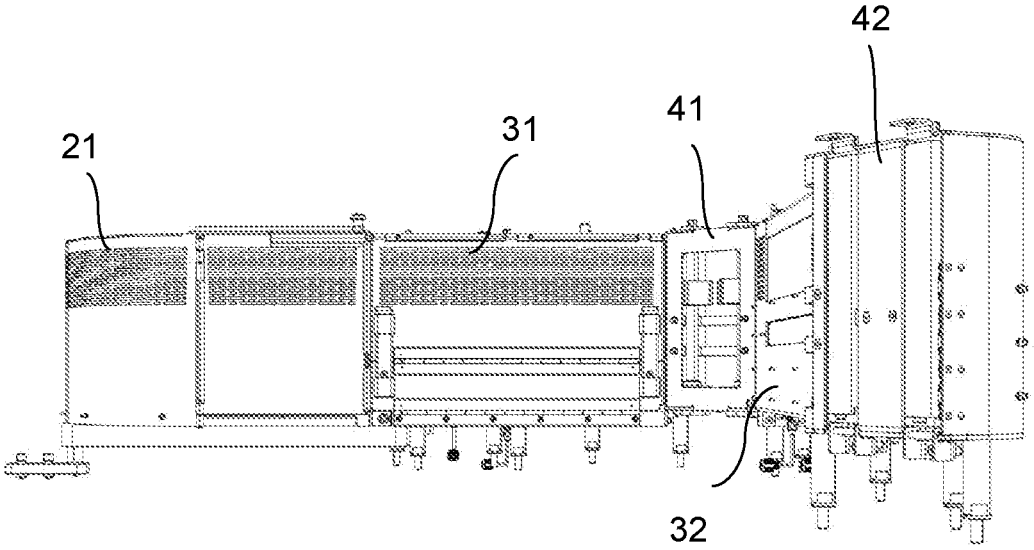
FIG. 3 shows another general perspective view of the device of FIG. 1.

The medium-caliber ammunition rack device 1 according to one preferred embodiment of the present invention, shown in a general view in FIGS. 1 to 3, is a system made up of:

one or two circular turntables or feeders 21, 22 (and in the case at hand, two turntables in the figures), if applicable of different sizes, placed at the rear of the turret (the front of the turret is the side where the barrel is located), a first conveyor 31 and a first ratchet box 41 situated directly at the outlet of the feeder(s), and a second conveyor 32 and a second ratchet box 42 both located on the same side in the turret, for example on the side of the commander (the position of the shooter being opposite).

Figure 4:
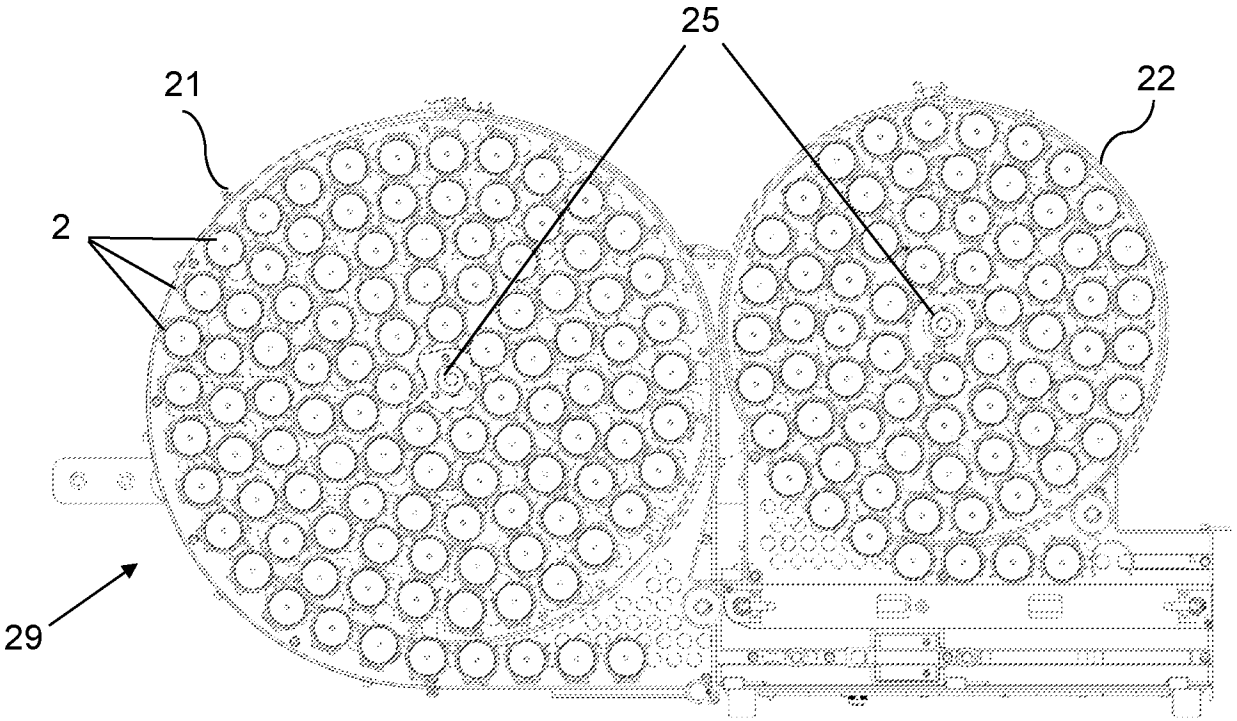
FIG. 4 shows a detailed top view of the two turntables supplied with ammunition strips or chains arranged in a spiral.

The junction between the medium-caliber ammunition rack 1 and the barrel is achieved through hoses (see reference 61, in FIGS. 7 and 8) connecting the second ratchet box 42 to the barrel. As shown in FIG. 4, the presence of two feeders 21, 22 in this embodiment defines the conveyance of two parallel strips or chains of medium-caliber ammunition 2 from the feeders to the barrel. The (re)loading and/or unloading of the strips or chains of medium-caliber ammunition in the feeders occurs along a spiral path 29, each strip or chain being attached to one end of the axle 25 of the feeder using any device, known by those skilled in the art, such as a clip secured to the axle. According to an alternative embodiment, the medium-caliber ammunition rack may only have one feeder, which defines the conveyance of a single strip or chain of ammunition between that sole feeder and the barrel. However, the device with two turntables advantageously allows to increase the (re)loading and/or unloading capacity or even to use two different types of medium-caliber ammunition at the same time, but still on the same caliber since the barrel only accepts one (for example, 30 or 40 mm).

According to one embodiment, the turntables could be made in the form of plates having orifices, such as plates of the grating type, on the one hand to make the device lighter and on the other hand to allow the discharge of dust, dirt or any other object or debris that may accidentally ignite the ammunition, in particular when the vehicle is moving. Furthermore, the cylindrical side walls of the feeders can also have, in addition to a protection function, a guiding function for the medium-caliber ammunition arranged along the strip or chain wound in a spiral around the axle of the turntable.

According to another embodiment, the turntables could be mounted on annular base pedestals, for example but not necessarily, bolted on the floor of the turret and fastened thereto using hooks, or any other fastening system, to prevent any untimely vertical movement of the turntable, especially when the vehicle is moving.

According to another embodiment, the turntables are mounted rotating around their vertical axle via rolling bearings allowing to reduce friction.

According to another embodiment, the turntables may have a retractable central axle that allows to stack them, for example to facilitate the transport of the turntables in the turret or to allow retractable optics to be lowered during transport.

Braking means may also be provided at the level of the turntables in order to control the inertia of the medium-caliber ammunition and to prevent that it causes the rotation of the turntable when the barrel stops operating.

Advantageously, the friction along the entire path of the medium-caliber ammunition is greatly reduced thanks to the use of HDPE strips.

One element of the invention lies in the fact that this device allows and favors a guided and pulled conveyance of pieces of medium-caliber ammunition without any other motor means than those proposed by the motor of the barrel along two parallel strips or chains 2 from the feeders (21, 22) to the barrel, the parallel strips or chains placed on the side of the commander. All of the provisions according to the invention to minimize the friction of the pieces of medium-caliber ammunition during their conveyance toward the barrel contribute to making any additional pulling means superfluous other than the pulling provided by the motor of the barrel.

Furthermore, for reasons that clearly appear in the remainder of the description, both the circular magazines and the conveyors and ratchet boxes are outwardly provided with protective metal sheets, either on their sides, or at the level of their upper part (roof).

According to preferred terms of the invention, the (re) loading and/or unloading of the pieces of medium-caliber ammunition can advantageously be achieved through the hatches provided in the feeder(s) and the conveyors, either from within or from the outside of the turret, following the rotation or pivoting of certain opening walls provided at the level of the feeder(s) or the conveyors, respectively, on the sides and/or at the level of the roof thereof.

Figure 5:
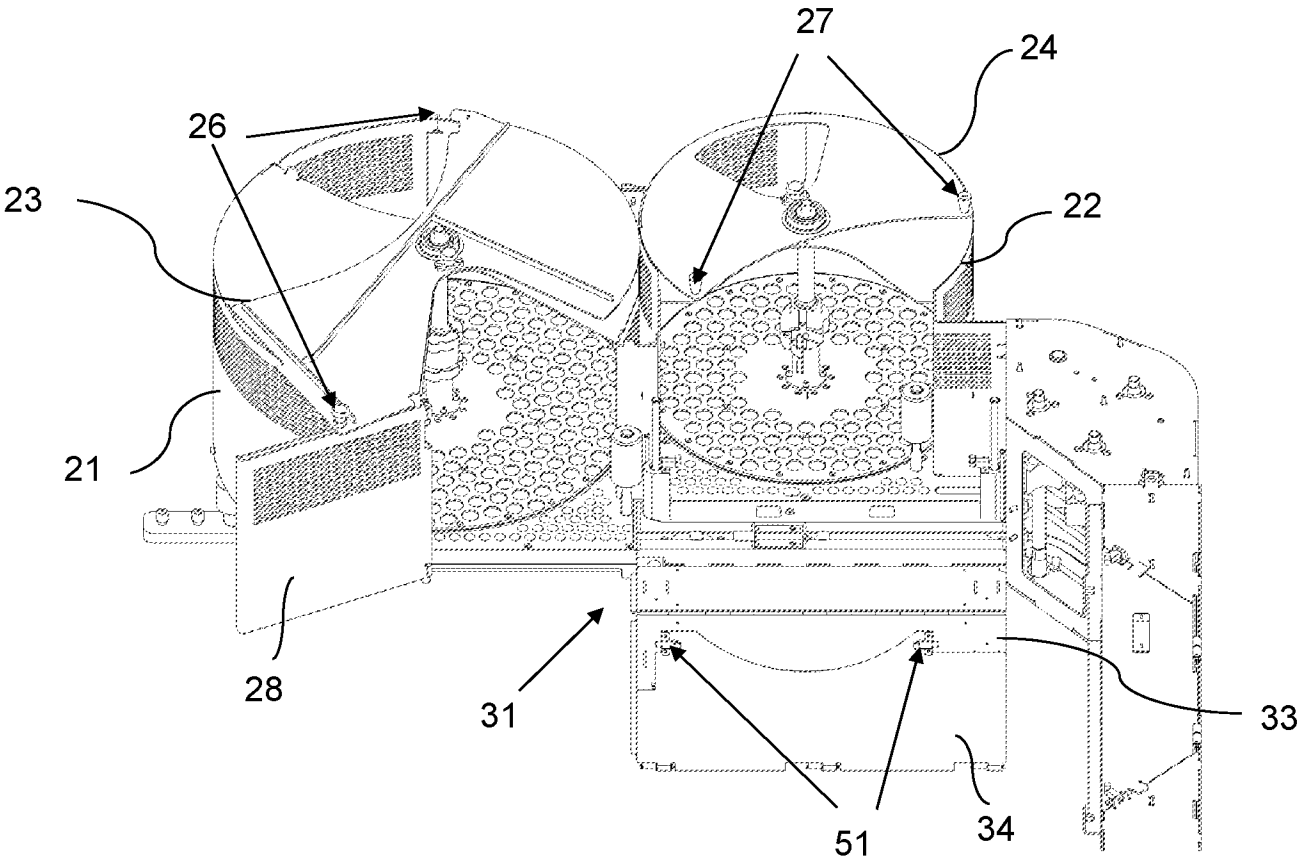
FIG. 5 shows a detailed view of the side and/or roof openings that can be formed on the turntables and the first conveyor.

On the one hand, the opening wall 23, 24 at the level of the roof of one (or both) turntable(s) 21, 22 can be designed such that a rotation occurs following a clockwise movement of this roof wall around the central axle of the feeder 25 using two small handles 26, 27 located on the roof of each feeder, allowing to perform this rotation manually. In the example provided here, one of the feeders 21 is also provided, in addition to the roof opening, with a side hatch 28 mounted pivoting around a vertical hinge. Owing to these hatches, inside and/or outside (re)loading and/or unloading is (are) possible and can even be done simultaneously (FIG. 5). Indeed, when the two openings are accessible at the same time, it suffices to have two people, one outside and the other inside the turret, to:

i) (re)load and/or unload the medium-caliber ammunition (by the individual located inside and/or outside the turret), as well as to ii) convey the medium-caliber ammunition to the barrel (by the individual inside the turret).

Figure 6:
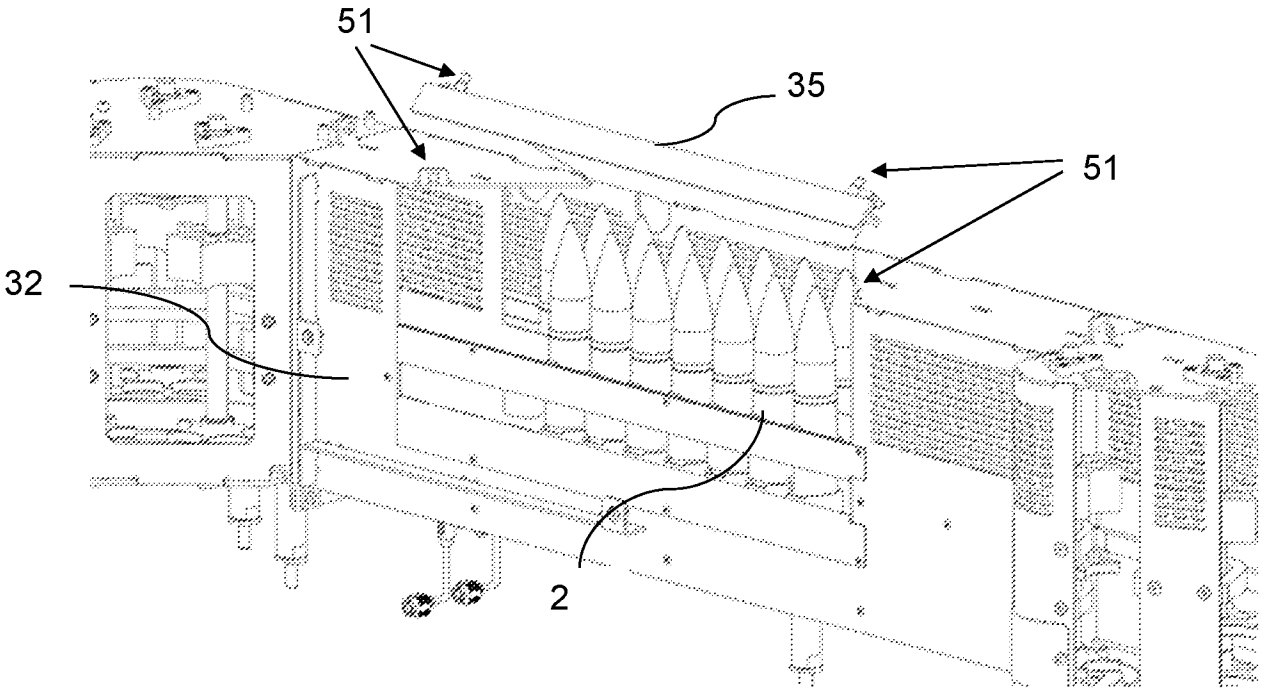
FIG. 6 shows a detailed view of the loading window arranged at the level of the second conveyor, in which it is possible to detach and/or reattach a medium-caliber ammunition strip or chain.

Furthermore, in the example described here, the two conveyors are designed such that the (re)loading and/or unloading can only be achieved from inside the turret (FIGS. 5 and 6). According to the embodiment shown in FIG. 5, the first conveyor 31 has a possibility of opening at the level of the side 33 and upper 34 plates. The side plate 33 is mounted pivoting around the fixed part of the rack, owing to a horizontal hinge, and the conveyor roof plate 34 is mounted pivoting around the side plate 33 owing to another horizontal hinge. Thus, when the corresponding hatch is opened, the roof plate 34 can fold on the side plate 33, with very little bulk. Furthermore (FIG. 6), the second conveyor 32 opens only from its upper part via a plate 35 mounted pivoting around a horizontal hinge.

The examples shown here as hatches or openings in the feeders and in the conveyors are provided solely as an illustration, with the understanding that other possible configurations fall within the scope of the invention. The structures made up of removable mobile plates provided with hinges allow to easily form an opening for access to the medium-caliber ammunition and for (re)loading and/or unloading thereof in the conveyors owing to the use of "clips" and bolts 51, which allow quick (un)locking (FIGS. 5 and 6). The different openings also allow easier access in case of maintenance to be performed and for any other part replacement.

These features related to the (re)loading and/or unloading of medium-caliber ammunition favor increased safety inside the turret, given that the bulk inside the turret has been drastically reduced.

Figure 7:
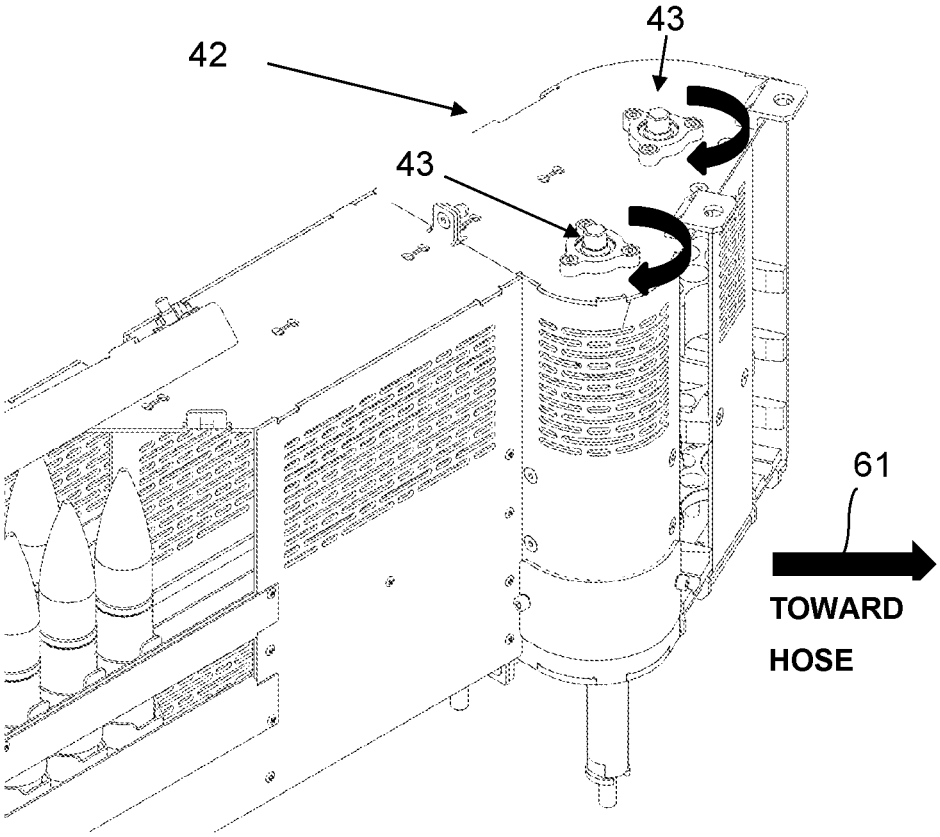
FIGS. 7 and 8 show a detailed view of a ratchet box used according to the present invention.
Figure 8:
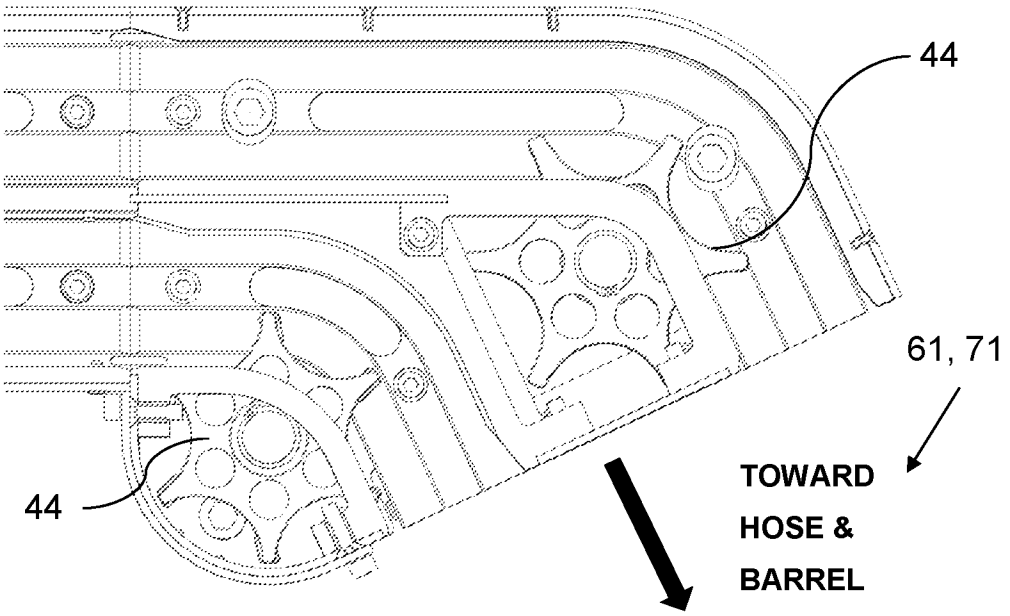

The respective ratchet boxes 41, 42 allow a pulled and guided conveyance of the medium-caliber ammunition over their entire path, with change of direction, solely owing to the rotation of an axle 43. This axle 43 is provided with at least two hexagonal wheels 44, each side of which has a housing allowing to accommodate a piece of medium-caliber ammunition. According to one preferred embodiment of the invention, this axle 43 is outwardly completed to be manually set in rotation, for example using a standard 14 mm socket wrench (FIGS. 7 and 8). Thus, it is possible to scroll/convey short strips or chains of medium-caliber ammunition (re)loaded in the feeder(s) or in the conveyors around the axle of the ratchet boxes so as to guide them, pull them partially on the path toward the barrel and optionally attach them to the strips or chains still located in the ammunition rack (between the feeder(s) and the barrel, in case of reloading). This manipulation favors improved general ergonomics of the turret. A second advantage related to this axle 43 lies in the fact that a reduction in friction occurs between the turn described by the medium-caliber ammunition and said ammunition owing to the addition of a rolling ball bearing, the friction torque of which is practically zero.

The present invention has the following advantages:

- no need for external motor power, which increases the reliability of the device, the motor of the barrel sufficing on its own;
- a lighter device than those of the state of the art. This allows to consider the possibility of removing all or part of the medium-caliber ammunition rack from the turret and at least partially filling it outside said turret, before replacing it and once again fastening it to the inside of the turret;
- a device that can be entirely made from a light metal such as aluminum, which saves weight;
- a compact system located on the same side within the turret, in other words having a greatly reduced bulk;
- ease of loading either from the inside or from the outside of the turret via a practical mobility at the level of the metal sheets making up the structural elements of the device, for example via small handles (in particular at the level of the feeder(s)) and/or clips (on the conveyors);
- decreased friction with the HDPE strips over nearly the entire journey;
- an adaptability to different types of ammunition without changing the component elements of the device, owing to the present development of guiding exclusively achieved on a cartridge case without touching the head of the ammunition. It will be noted in this respect that, for the 30 and 40 mm calibers for example, the shape and diameter of the cartridge case are identical.

These advantages greatly offset some drawbacks, such as residual vibrations at the level of the component metal sheets of the structural elements, the noise from ammunition "jumping" during conveyance or the use of hoses.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 ammunition supply device
2 ammunition
21 first feeder
22 second feeder
23 roof hatch
24 roof hatch
25 central axle of the feeder
26 handle
27 handle
28 side hatch
29 spiral path
31 first conveyor
32 second conveyor

33 removable side plate of the first conveyor
34 removable upper plate of the first conveyor
35 removable plate of the second conveyor
41 first ratchet box
42 second ratchet box
43 ratchet box axle
44 hexagonal wheel
51 clip
61 hose
71 barrel

The invention claimed is:

1. A medium-caliber ammunition supply device for a turret mounted on an armored vehicle, comprising:

at least one circular turntable, configured to be placed at the rear of the turret, configured to position medium-caliber ammunition in a strip or chain, vertically and along a spiral path; and structural elements for guided and pulled conveyance of the strip or chain of medium-caliber ammunition, which structural elements successively comprise a first conveyor, a first ratchet box, a second conveyor, and a second ratchet box, wherein the at least one circular turntable and the structural elements are covered with a sheet-metal protection on at least one of on their side faces or on an upper part or roof, the sheet-metal protection having mobile hatches mounted in a rotating or pivoting manner, allowing partial or complete and at least one of ergonomic loading or unloading of the at least one circular turntable with medium-caliber ammunition, either when stopped or during movement of the vehicle, from at least one of inside or outside of the turret and allowing access to the medium caliber ammunition or at least one of loading or unloading thereof in the conveyors.

2. The medium-caliber ammunition supply device according to claim 1, wherein the two ratchet boxes each have an axle configured to be rotated manually to allow a partial motion on the strip or chain of medium-caliber ammunition toward a barrel of the vehicle from outside the device.

3. The medium-caliber ammunition supply device according to claim 2, wherein the axle has an outside machining allowing it to be rotated by a socket wrench.

4. The medium-caliber ammunition supply device according to claim 1, wherein the at least one circular turntable comprises at least two circular turntables associated with the guided and pulled conveyance of corresponding strips or chains of medium-caliber ammunition.

5. The medium-caliber ammunition supply device according to claim 1, wherein the mobile hatches of the sheet-metal protection, when mounted in a rotating manner, comprise at least two circular sectors configured to slide relative to one another at a level of the roof of the at least circular turntable and are configured to be actuated using handles.

6. The medium-caliber ammunition supply device according to claim 1, wherein the mobile hatches of the sheet-metal protection, when mounted in a pivoting manner, comprise sheet-metal plates mounted on hinges configured to be unlocked by opening clips or bolts.

7. The medium-caliber ammunition supply device according to claim 1, wherein the sheet-metal protection of the at least one circular turntable comprises at least a mobile sheet-metal hatch mounted in a rotating manner and a mobile hatch mounted in a pivoting manner.

8. The medium-caliber ammunition supply device according to claim 1, wherein the sheet-metal protection of the structural elements comprises at least a mobile sheet-metal hatch mounted in a pivoting manner.

9. The medium-caliber ammunition supply device according to claim 1, further comprising a mechanical fastening system connecting a first piece of medium-caliber ammunition to a central axle of the at least one circular turntable, the ammunition being stored in a form of a spiral path at a level of the at least one circular turntable.

10. The medium-caliber ammunition supply device according to claim 4, wherein the two conveyors have an open loading window configured for at least one of the loading or unloading of strips or chains and the attachment of medium-caliber ammunition at least one of when at least one circular turntable of the at least two circular turntables is empty or when the second conveyor requires it, respectively.

11. The medium-caliber ammunition supply device according to claim 1, further comprising at least one mechanical sensor configured to detect an end of a strip or chain for each ammunition strip or chain path in order to detect a number of pieces of medium-caliber ammunition remaining in the device.

12. The medium-caliber ammunition supply device according to claim 1, wherein the structural elements are configured for passage from one type of ammunition to another, with no geometric and technical modification or constraint.

13. The medium-caliber ammunition supply device according to claim 4, wherein each of the at least two circular turntables has a retractable central axle that allows stacking on a similar turntable.

14. The medium-caliber ammunition supply device according to claim 4, wherein the at least two circular turntables have opening systems configured for simultaneous at least one of loading or unloading from inside and outside of the turret.

15. The medium-caliber ammunition supply device according to claim 2, wherein a single shared socket wrench can be used to manipulate and convey the medium-caliber ammunition along the entire device.

16. An armored-vehicle turret comprising the medium-caliber ammunition supply device according to claim 1, further comprising:

a barrel; and hoses configured to connect the structural elements to the barrel at one end of the structural elements located on a same side as the barrel within the turret.

17. The medium-caliber ammunition supply device according to claim 4, wherein the at least two circular turntables are of different sizes.

18. The armored-vehicle turret according to claim 16, wherein the same side of the barrel within the turret comprises a side of a commander of the armored vehicle.

* * * * *